United States Patent [19]

Pelazza

[11] 4,320,589

[45] Mar. 23, 1982

[54] SNOWPLOW APPARATUS

[76] Inventor: Andrea Pelazza, Strada Cuorgné 68, Mappano Caselle, Turin, Italy

[21] Appl. No.: 42,865

[22] Filed: May 29, 1979

[30] Foreign Application Priority Data

May 26, 1978 [IT] Italy ..... 68215 A/78

[51] Int. Cl.[3] ..... E01H 5/06; A01B 61/04

[52] U.S. Cl. ..... 37/42 UL; 172/261; 172/294

[58] Field of Search ..... 37/42 UL, 42 R, 41; 172/261, 263, 294

[56] References Cited

U.S. PATENT DOCUMENTS

| | | | |
|---|---|---|---|
| 2,643,470 | 6/1953 | Kaeser | 37/42 R |
| 3,808,714 | 5/1974 | Reissinger et al. | 37/42 UL |
| 3,893,518 | 7/1975 | Farrell | 37/42 UL X |

FOREIGN PATENT DOCUMENTS

| | | | |
|---|---|---|---|
| 769436 | 10/1967 | Canada | 172/261 |
| 770388 | 10/1967 | Canada | 172/261 |
| 2450486 | 5/1975 | Fed. Rep. of Germany | 37/42 UL |
| 913047 | 8/1946 | France | 37/42 R |
| 131329 | 6/1978 | German Democratic Rep. | 172/261 |

*Primary Examiner*—Steven A. Bratlie
*Attorney, Agent, or Firm*—Robert B. Frailey

[57] ABSTRACT

An improved snowplow apparatus provided with articulated quadrilateral means permitting vertical movement of a snow clearing blade which is kept in a lowered position by a compressed gas accumulator communicating with one or two hydraulic cylinders connected between the snow clearing blade and a supporting frame therefor which is secured to a tractor. When the force exerted by said blade as it encounters an obstacle on a road exceeds the resistance of the accumulator, the pistons of the two cylinders are moved to supply hydraulic fluid under pressure to a hydraulic ram for lifting the blade.

3 Claims, 3 Drawing Figures

SNOWPLOW APPARATUS

BACKGROUND OF THE INVENTION

This invention relates to an improved snowplow apparatus and more particularly to a snowplow apparatus in which the snow clearing blade is capable of passing over small obstacles projecting from the ground without damage to the blade or the tractor pushing it.

In conventional snowplows the presence of an obstacle projecting from the road surface, such as a curb, step, projecting drain cover or the like, that cannot be overcome by the snowplow scraper blade, gives rise to a hitch and causes enormous stress in the snow clearing blade and its supports so that the blade and its supports may be deformed and/or broken and/or the tractor may be damaged. To avoid this drawback, some conventional snowplows are provided with counteracting spring means generally comprising large helical springs adapted to normally keep the blade in the operative position, but yielding and permitting the snow clearing blade to tilt forwardly when the scraper blade at the lower edge of this blade knocks against an obstacle anchored to the ground, to permit the obstacle to be overcome. When the blade has cleared the obstacle, it returns to its operative position under the action of the springs.

But even with this safety means the problem of overcoming obstacles anchored to the ground cannot be solved in a satisfactory manner because the time of response of the counteracting spring means is too long and the apparatus and/or the tractor may be damaged in spite of the springs. Moreover, in many cases it is not sufficient for the blade to tilt forwardly to clear the obstacle. Finally, it often happens that when the spring constant of the return springs is so dimensioned that the spring will yield readily when the blade knocks against an obstacle, the spring will also permit the blade to tilt in normal operating conditions when the snow to be removed is too heavy and thick as in this case the resistance offered by the compressed coat of snow may cause the springs to yield when it is not required.

SUMMARY OF THE INVENTION

It is therefore an object of the present invention to provide a snowplow apparatus that eliminates the aforementioned drawbacks of the prior art and more particularly causes the snow clearing blade not only to tilt but also to be lifted, to facilitate clearing of the obstacle.

This and other objects and advantages, which will become evident in the course of the following description, are achieved according to the invention by providing a snowplow apparatus in which the snow clearing blade is carried by a supporting frame adapted to be mounted in front of a tractor or the like by articulated quadrilateral means adapted to permit vertical movement of the blade, the blade being also mounted for pivotal movement about a horizontal axis extending parallel to its lower scraping edge, this snowplow apparatus being characterized in that it further comprises a hydraulic ram adapted, when pressurized, to lift said blade, a first hydraulic cylinder connected between said blade and its supporting frame and communicating with said hydraulic ram to pressurize the latter when said blade pivots forwardly about said horizontal axis of rotation, and maximum pressure counteracting resilient means to prevent said blade from pivoting unless and until it encounters a resistance exceeding a predetermined value.

DESCRIPTION OF PREFERRED EMBODIMENTS

Figure 1:
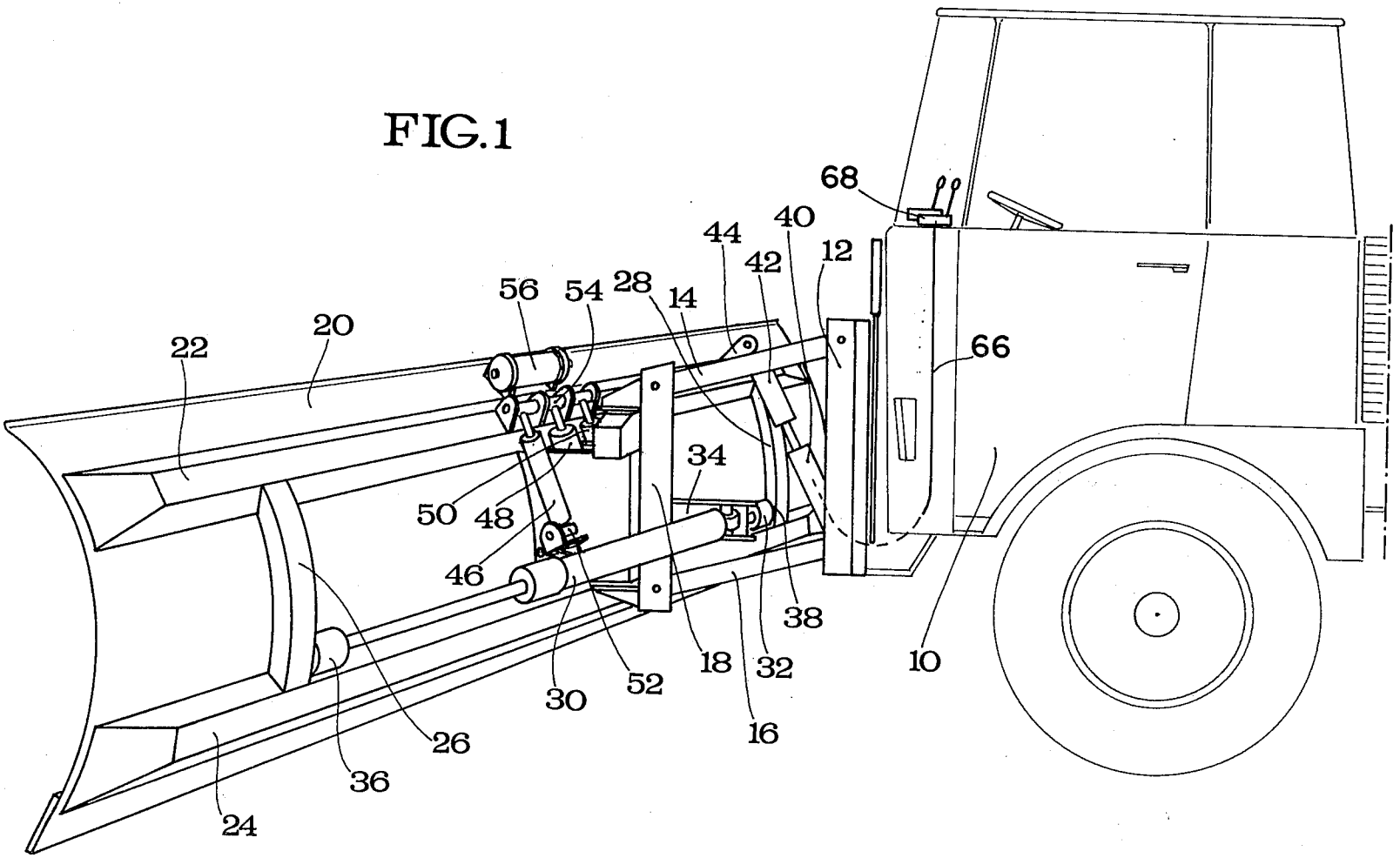
FIG. 1 is a perspective rear view of a snowplow apparatus according to a first embodiment of the invention.

Referring to FIG. 1, a motor vehicle 10, for example, a truck used as a tractor, carries at its front end a frame 12 which supports a snow clearing blade 20 through articulated rods 14, 16 forming a quadrilateral framework pivotally connected to a vertical plate 18. The snow clearing blade 20 is provided with reinforcements such as 22, 24, 26, 28 and is mounted for pivotal movement about a horizontal and a vertical axis.

The position of the snow clearing blade with respect to its vertical axis of rotation, i.e. the oblique position of the blade with respect to its forward movement, can be adjusted by means of a pair of symmetrical rams 30, 32 extending between a center support bar 34, secured to the vertical plate 18, and a pair of symmetrical points 36, 38 on the snow clearing blade.

A pair of hydraulic rams 40, 42 disposed in tandem is interposed between the frame 12, secured to the tractor 10, and a position 44 on the plate 18 to lift the latter and thus the blade 20 when actuated. The hydraulic ram 40 is connected through a suitable hydraulic system (not shown) to the usual pressure control box located in the driver's cabin, and can be actuated to lift the blade 20 vertically.

Further, three hydraulic cylinders 46, 48, 50 are connected between a position 52 on the plate 18 and a position 54 on the blade 20. Finally, also mounted on the blade 20 is a pressure accumulator 56, for example, of the compressed nitrogen chamber type.

Figure 2:
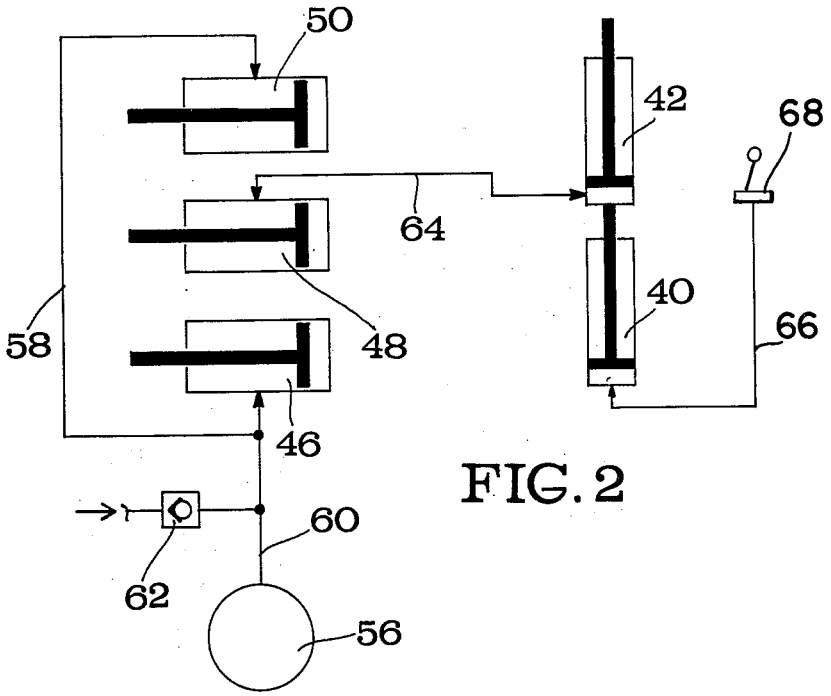
FIG. 2 is a schematic diagram of an hydraulic circuit incorporated in the snowplow apparatus of FIG. 1.

Referring now to FIG. 2, the two hydraulic cylinders 46, 50 are connected through lines 58, 60 to the compressed nitrogen accumulator 56. A check valve 62 permits the accumulator to be loaded to a desired pressure of the order of several hundred atmospheres. The hydraulic cylinder 48, on the other hand, is connected through a line 64 to the ram 42.

Under normal operating conditions the force acting on the blade 20 and tending to tilt the blade forwardly is offset by the pressure in the accumulator 56, which tends to keep the cylinders 46, 50 in their end positions shown in FIG. 2. However, when the force acting on the blade 20 exceeds the gauge pressure of the accumulator 56, for example, when the blade meets with an obstacle on its path of movement, the pistons of the cylinders 46, 50 move to the left in FIG. 2 and consequently also the piston of the cylinder 48 moves to the left as the latter is mechanically connected to the other cylinders (cf. FIG. 1). Therefore, pressure is applied to the ram 42 which immediately lifts the blade 20 to clear the obstacle. When the obstacle has been cleared, the force tending to tilt the blade ceases and the accumulator 56 returns the stored pressure energy to move the cylinders 46, 50 back to their normal positions corresponding to the normal operating position of the blade. Thus, the hydraulic fluid can return from the ram 42 to the cylinder 48 permitting the blade 20 to return to its normal operating position.

Figure 3:
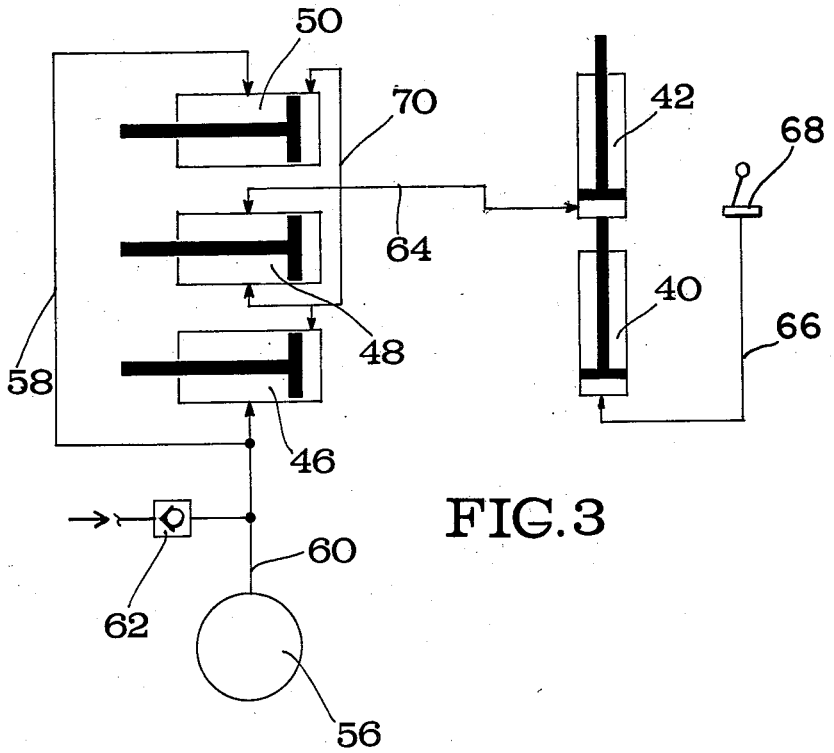
FIG. 3 is a schematic diagram of another embodiment of the hydraulic circuit.

The second embodiment of the snowplow apparatus according to the invention is structurally similar to the first one except that it comprises an improvement to the hydraulic circuit. This hydraulic circuit is shown in FIG. 3 in which the same reference numerals have been used for parts similar or corresponding to those shown in FIG. 2. In the circuit of FIG. 3 there is a connection line 70 between the discharge side of the cylinder 48 and the pressure side of the cylinders 46, 50. For the rest, all components and connections of the circuit are the same as in the first embodiment.

With the addition of the connection line 70, the snowplow apparatus behaves in the same manner as in the first embodiment under normal operating conditions. The force acting on the snow clearing blade and tending to tilt it forwardly is offset by the pressure in the accumulator 56, which tends to keep the cylinders 46, 50 in the end position shown in FIG. 3. However, when the force exerted on the snow clearing blade exceeds the gauge pressure of the accumulator 56, for example, when the blade encounters a fixed obstacle on its path of movement, the pistons of the cylinders 46, 50 move to the left in FIG. 3 and therefore also the piston of the cylinder 48 moves to the left as the latter is mechanically connected to the other cylinders. Consequently, pressure is applied to the ram 42 which immediately lifts the blade to clear the obstacle.

However, whereas in the first embodiment the lift ram 42 had to overcome not only the reaction force constituted by the weight of the blade, but also that of the two cylinders 46 and 50, in this second embodiment through the connection line 70 the pressure of the cylinder 48 is also transmitted to the cylinders 46 and 50 to facilitate movement of their pistons. Consequently, the load on the ram 42 is considerably reduced and this ram can act more readily and efficiently when the snow clearing blade has to be lifted.

Although two preferred embodiments of the invention have thus been described herein in detail and illustrated in the accompanying drawings, it is to be understood that numerous changes and modifications obvious to one skilled in the art may be made therein without departing from the scope of the inventive idea which consists in that a signal indicating that a maximum force, which the snow clearing blade is allowed to take up, has been exceeded, is used to cause pressurization of the lift rams of the blade until the exertion of such an exceptional force has ceased to permit the blade to clear obstacles fixed on the ground.

It is also evident that most of the components of the snowplow apparatus according to the invention may be replaced by other equivalent components. For example, the two cylinders 46, 50 communicating with the accumulator 56 may be replaced by a single cylinder and the accumulator 56, instead of being a compressed nitrogen accumulator, may be a different type of pressure energy accumulating means such as a mechanical spring or the like.

I claim:

1. A snowplow apparatus by which a snow clearing blade is moveably connected by articulated quadrilateral means to a supporting frame mounted on the front of a vehicle, said articulated means being operative to permit vertical movement of the blade, pivotal movement of the blade about a horizontal axis extending parallel to its lower scraping edge and pivotal movement of the blade about a vertical axis disposed centrally of the blade, said pivotal movement about said vertical axis being effected by actuating means connecting said blade to a center support bar on said articulated quadrilateral means, characterized in that said snow plow apparatus further comprises (a) a hydraulic ram connected between said blade and said supporting frame and adapted, when pressurized, to lift said blade, (b) a first hydraulic cylinder connected between said blade and said articulated quadrilateral means and communicating with said hydraulic ram to pressurize said ram to lift said blade when the blade pivots forwardly about said horizontal axis of rotation upon encountering resistance from an obstacle anchored to the ground and (c) maximum pressure counteracting resilient means to prevent said blade from pivoting unless and until it encounters a resistance exceeding a predetermined value, said maximum pressure counteracting means comprising at least one second hydraulic cylinder mechanically connected to said first hydraulic cylinder so as to carry out the same movements as said first hydraulic cylinder and a pressure energy accumulating means operatively connected to said second hydraulic cylinder.

2. A snowplow apparatus as claimed in claim 1, wherein said accumulating means is a compressed gas accumulator.

3. A snowplow apparatus as claimed in claim 1, wherein said first hydraulic cylinder also communicates with said second hydraulic cylinder at the end thereof opposed to that which communicates with said pressure energy accumulating means.

* * * * *